US006148543A

United States Patent [19]

Chapman

[11] Patent Number: 6,148,543

[45] Date of Patent: Nov. 21, 2000

[54] METHOD AND APPARATUS FOR DRYING IRON ORE PELLETS

[76] Inventor: Daniel R. Chapman, 5750 N. Camino Esplandora, #121, Tucson, Ariz. 85718

[21] Appl. No.: 09/455,384

[22] Filed: Dec. 6, 1999

[51] Int. Cl.[7] ..... F26B 7/00

[52] U.S. Cl. ..... 34/424; 34/508; 34/210; 34/230

[58] Field of Search ..... 432/130, 144, 432/152; 110/221, 224, 268, 269, 270, 328; 34/423, 424, 507, 508, 509, 510, 201, 210, 218, 230

[56] References Cited

U.S. PATENT DOCUMENTS

| | | | |
|---|---|---|---|
| 2,671,968 | 3/1954 | Criner | 34/509 |
| 3,868,245 | 2/1975 | Boss . | |
| 3,868,246 | 2/1975 | Boss . | |
| 3,894,344 | 7/1975 | Malcolm . | |

OTHER PUBLICATIONS

Haas L.A. and K.W. Olson. Effects of Magnetite Oxidation on the Properties of Taconite Pellets. Paper in Proceedings of 64th Annual AIME Meeting (Duluth, MN, Jan. 16–17, 1991) SMME(AIME), 1991, pp377–394.

Haas L.A. et al. Use of Oxygen–Enriched Gas for the Oxidation of Acid and Fluxed Taconite Pellets. BuMines RI 9473, 1993, 15 pp.

Meyer K. Pelletizing of Iron Ores. Springer–Verlag Press, Berlin, Germany, 1980, pp. 24–37.

Meyer K.J.E. and H. Rausch. The Lurgi Pelletizing Process: A Combined Updraft–Downdraft Technique. J. of Metals, V.10, 1958, pp. 129–133.

*Primary Examiner*—Pamela A. Wilson
*Attorney, Agent, or Firm*—James V. Harmon

[57] ABSTRACT

In the present method of drying iron ore pellets, e.g., magnetite pellets, moisture-containing iron ore pellets are formed into a bed comprising a multiplicity of the pellets. A current of drying gas is forced upwardly through the bed of pellets to at least partially dry some of the pellets. A plurality of pipes, each having an opening such as an elongated slot provides counter-current jets of a drying gas above the bed. The drying gas jets are directed downwardly so as to impinge on the upper surface of the bed through which the current of drying gas rises. The bed of pellets is thus dried with the current of drying gas flowing through the bed from below as well as the jets of drying gas impinging onto the upper surface of the bed. In a preferred form of the invention, in a second stage downwardly directed jets of drying gas are used together with a downward current of drying gas to further dry the pellets before they are fired.

18 Claims, 8 Drawing Sheets

23
22
20
36
10
12
16
18
14
24
26
28
30
32
34

MOISTURE CONTENT OF PELLETS
WITHOUT DOWNDRAFT JETS
50
52
Bed thickness in inches
15
14
13
12
11
10
9
8
7
6
5
4
3
2
1
WB1
WB2
WB3
WB4
WB5
WB6
WB7
WB8
0 — 1min. — 2min. — 3min. — 4min. — 5min. — 6min. — 7min. — 8min.
KEY FOR FIGURES 7 AND 8
Condensed water added >11%
10-11% water
Original water content eg 10%
<10% water
<6% water

MOISTURE CONTENT OF PELLETS WITH DOWNDRAFT JETS

PELLET TEMPERATURES °F
Bed thickness in inches
10
50
52
Zone 5
15 14 13
105 100
110 120
125 110
140 115
150 130
200 170
220 190
250 205
Zone 4
12 11 10
100 100
100 100
120 120
130 130
140 140
165 155
175 160
195 165
Zone 3
9 8 7
100 100
110 110
130 130
145 145
160 160
180 175
190 180
195 185
Zone 2
6 5 4
110 110
130 130
150 150
165 165
180 180
200 195
200 200
210 205
Zone 1
3 2 1
120 120
150 150
170 170
185 185
200 200
200 200
210 205
210 210
WB1
WB2
WB3
WB4
WB5
WB6
WB7
WB8
KEY
Temperature with invention
200 170
Temperature without downward jet

METHOD AND APPARATUS FOR DRYING IRON ORE PELLETS

FIELD OF THE INVENTION

This invention relates to drying processes, and more particularly to a method and apparatus for drying iron ore pellets.

BACKGROUND OF THE INVENTION

Several processes have been in use over the years for drying green, i.e., moist, iron ore pellets, e.g., hematite, magnetite or limonite. The objective of these processes is to remove residual moisture so as to produce a strong fired pellet having maximum abrasion and breakage resistance as adjudged by crushing tests, optimum porosity and, where stored in cooler climates, good resistance to repeated freezing and thawing. In treating certain ores the process should also provide optimal oxygenation, since poor strength may otherwise result in the case of magnetite pellets where oxidation to $Fe_2O_3$ is not complete, leaving magnetite cores in the center of the pellets.

Prior methods employed in drying iron ore pellets will now be described briefly by way of example in connection with the drying of magnetite pellets obtained from taconite. It should be understood, however, that although the present invention is described in connection with a particular ore, it is not limited to specific apparatus or processes described.

For the last 45 years the beneficiation of magnetite-containing rock has consisted of crushing, grinding and milling the ore. The specific operation consists of separating the desired material from the gangue (waste) material through hydraulic separation, magnetic separation, and by chemically treating the ore to further enhance the separation of the ore from the waste rock.

The material separated from the waste material is called concentrate. The total iron may range from 65% to 69% or other economically practical value. The concentrate is generally described as a powder with the general size that can pass through a screen of a selected size. The screen usually used is a U.S. Standard Tyler Screen of 325 and 500 mesh to the inch. The 500 mesh screen has openings about 27 microns in diameter.

Some of the general size descriptions might be 85% minus 325 mesh and 75% minus 500 mesh as an example. The percentage values correspond to the amount of grinding necessary to liberate the desired product from the waste product. The grinding, milling and treatment of the ore generally occur in a section of the plant called the concentrator, hence the name concentrate.

The concentrate is generally piped in an aqueous slurry of 60% solids to a vacuum filter. The vacuum filter removes most of the water from the slurry. The resulting product is called a filter cake with generally less than 10% water. The amount of water is controlled by the efficiency of the filtering operation and also by the size of the particles in the concentrate. The concentrate (filter cake) is generally conveyed to storage bins before being fed into a disk or drum balling device.

The concentrates have additives to improve the balling, firing or chemical composition of the product once it has been fired. Some of the common additives are bentonite clay, limestone in the form of calcium hydroxide if fluxed pellets are produced, and sometimes an organic binder.

The balling of concentrate is accomplished in a process in which the material is rolled in stages that increase the size of the pellet by applying a layer of concentrate upon a smaller pellet until the pellet reaches the desired size. The product from a balling drum is screened to selectively size the product. The undersized material is circulated back into the balling drum. The circulated material is called seed pellets. The balling action applies the concentrate to minimize interstitial spaces, hence smaller particles are forced between larger particles. The mixture of particle sizes makes a pellet of maximum density. The additives also fill the interstitial spaces and often provide a pathway for the gradual removal of water from the inside of the pellet. Pathways are also provided for oxygen to enter the inside of the pellet during the firing of the pellet. Knowledge of the removal of water from the inside of pellets is necessary to appreciate the contributions that the present invention provides towards the firing of magnetite pellets. An adequate preliminary description of the equipment and the mineral beneficiation process has been provided. It is also necessary to describe the physical and chemical changes in each section of a pelletizing machine.

The prior drying process and some of the limitations of that system which negatively impact on the next stage of the pelletizing process (the firing of the pellets) will now be described. It should be noted, however, that even a detailed explanation of the physical changes of the product is an oversimplification of a complex process.

The finished pellets are screened and placed on conveyor pallets each having grate bars at its bottom that holds the pellets as they travel through the furnace. The pellets are placed gently on the pallet grate bars to form a level bed of pellets at a depth that has been established through practical experience. The depth is usually about 15 inches or more in thickness. Quite frequently, a layer of recently fired pellets is first placed upon the grate bars to form a layer of fired pellets about 3 inches thick. The fired pellet layer is called a hearth layer. Each pallet is part of an endless track conveyor about 300 feet long and often 8 to 12 feet wide. One common conveyor is called a traveling grate machine. The conveyor is part of and contained for the most part within the drying, firing,magnetite conversion and cooling zones of a furnace.

There are zones or sections of the furnace named to describe the process that occurs in each zone of the furnace. Generally, the first zone of a travelling grate furnace is the updraft drying zone. The present invention is used in this section of the furnace, as well as the next zone called the Downdraft Drying Zone (DDZ).

As an example, consider that a hearth layer of fired pellets 3 inches deep is placed upon the pallet grate bars. A layer of finished pellets 15 inches deep is then placed upon the hearth layer, making a total depth of 18 inches. The hearth layer is dry and the pellets in the finished pellet layer contain 10% water. The grate bars are aligned on the pallet to provide openings about ¼ inch wide to permit hot air to flow through the openings.

The updraft drying zone of the furnace consist of windboxes beneath the travelling grates. Each windbox is designed to provide a reasonably airtight seal to force air under pressure up through the bed of pellets that is on the travelling grate. A large quantity of air is directed up through both the hearth layer and the layer of finished pellets. The air temperature is generally 600° F. to 850° F. This description applies to a continuously travelling grate machine that is in equilibrium for temperature and airflow. As an example, consider an 8 ft. wide by 8 ft. long windbox. Assuming the grates travel 96 inches a minute, any pellets are above a windbox for one minute. During drying, hot air is forced up through the pellet bed by a forced draft fan. Sufficient upward velocity and static pressure is maintained to establish an upward airflow. The hot air blowing by the finished pellets evaporates surface water while water inside the pellets slowly evaporates. Some of the heat energy warms the pellets, but most of the heat is used to evaporate water on and within the pellets. The heating and evaporation proceeds from the bottom up through the pellet bed. The transfer of heat travels slowly up through the pellet bed. The evaporation of water cools the air by an amount of energy called the heat of vaporization. The heat transferred to solid masses such as the pallet frames, the hearth layer, the pellets and heat conducted to pellet water is called sensible heat transfer.

It is necessary to understand some of these physical changes to evaluate the potential attributes of my invention. Moist air travelling up through a bed of cold pellets is eventually cooled to the dewpoint temperature so that water vapor condenses on the cool pellets, thereby increasing the water content of the pellets. Air travelling up through the pellet bed also carries moisture entirely through the pellet bed. The amount of water removed is consistent with the moisture carrying capacity of the air. The amount of water vapor present is the 100% relative humidity value for the temperature that the air leaves the pellet bed. Water vapor removed in this manner is the primary way that water is removed from the pellet bed. Some of the water evaporated from the lower half of the pellet bed is, however, merely transferred by the condensing action to the cooler pellets in the upper portion of the pellet bed. The pellets on the top of the pellet bed increase in water content by the condensing of water vapor upon their surface so that pellets that originally had less than 10%, now will contain over 12% water, mainly on the surface of each pellet.

The volume of water removed in the updraft drying zone (UDZ) of the furnace probably exceeds 40 gallons of water per minute. The water removed passes through the top of the pellet bed as water vapor. Forty gallons per minute corresponds to 50% of the water contained in pellets entering the drying zone at a rate of 200 tons per hour.

The cooler pellets near the top of the pellet bed are at or below the dewpoint temperature. These pellets help control and establish the dewpoint of the moist air travelling upward through the bed of pellets. Essentially the 40 gallons of water removed as water vapor came from the lower section of the pellet bed.

At the end of the UDZ, the pellets at the bottom of the pellet bed are at the temperature and water content correct for the next stage of the firing process prior to the actual firing process. However, in the sequence being described they will not be fired until the end of the firing sequence. At the end of the UDZ the pellets in the top 4 inches of the pellet bed still are wet (over 10% water) and these are the pellets that are to be fired in the firing zone, the downdraft firing zone (DFZ) because the DFZ fires the top of the pellet bed first. Following the UDZ is the downdraft drying zone (DDZ) in which the air direction is down onto the pellet bed. The top pellets entering this zone are wet with a water content exceeding 10%. For a depth of 5 or 6 inches the pellets are wetter than when they were initially placed on the pallets. The thrust of air directed upon the pellet bed and the suction of a waste gas fan in the DDZ provide energy to draw air down through the bed of pellets. The pellets are in the downdraft drying zone of the furnace for only about 2 minutes.

Very little drying takes place in the DDZ of the furnace. This becomes clear when one considers how hard it is to suck air downwardly through 15 inches of pellets, especially when the top 6 inches are wet. Any water that is evaporated expands to steam and artificially increases the volume of gas travelling through the bed of pellets. This is an important factor upon which the present invention is based. The present invention will effectively minimize the problem caused by inadequate drying that occurs in both the updraft and downdraft drying zones of pelletizing furnaces.

Following the DDZ, the pellets enter the downdraft firing zone (DFZ) with no delay. The temperature in the DFZ is typically 1600° F. to 1800° F. The waste gas fan draws the heated air and combustion gasses through the pellet bed. Pellets that are wet to a depth of about 6 inches from the top of the bed with about 10% water are exposed to hot air (1800° F.) which flows downwardly through that mass of pellets.

The balling drum additives such as bentonite clay, organic binder, limestone or a similar basic oxide present in the pellets, provide pathways for water vapor to escape. The limestone is added when fluxed pellets are desired. While probably providing pathways for water vapor removal, it is likely that the limestone will maintain a higher moisture level than what would be present without the limestone. If adequate amounts of additives are not present to provide a pathway for steam to escape the pellets' interior, the pellets may explode and break off part of the outside of the pellet. This unfavorable characteristic is called spalling. With an adequate amount of additive present, however, the water in the pellet is escaping at the time that it would be desirable for oxygen to penetrate to the center of the pellet and begin the conversion of magnetite to hematite reaction. If complete conversion does not take place, a magnetite core results. Magnetite cores can be caused by introducing pellets with too much water into the firing zone of the furnace. The outer layers of the pellets are often sealed through grain growth, thus eliminating the possibility of oxygen reaching the center of the pellet. This is another way that magnetite cores can be produced. The magnetite cores contribute to breakage problems in transportation or inhibit proper blast furnace conversion.

In view of these and other deficiencies, there exists an important need for an improved ore pellet drying process that is not subject to the aforementioned problems and shortcomings.

It is therefore one objective of the present invention to provide an improved ore drying process suited for drying pellets of magnetite, hematite, limonite or other ores in which the pellets have improved strength, abrasion and breakage resistance.

Another object of the invention is to provide fired pellets with the aforesaid advantages which also have optimum moisture content, porosity and resistance to repeated freezing and thawing when fired pellets are produced.

A further object of the invention is to provide an improved ore drying process for hematite, magnetite or limonite wherein a more uniform drying is accomplished throughout all portions of the bed of pellets being dried due to the elimination or reduction of a moisture gradient between the top and bottom surfaces of the pellet bed and to eliminate or reduce the presence of magnetite cores in fired magnetite pellets.

These and other more detailed and specific objects of the present invention will be better understood by reference to the following figures and detailed description which illustrate by way of example of but a few of the various forms of the invention within the scope of the appended claims.

SUMMARY OF THE INVENTION

In the present method of drying iron ore pellets, moisture-containing iron ore pellets are formed into a bed comprising a multiplicity of the pellets. A current of drying gas is forced upwardly through the bed of pellets to at least partially dry some of the pellets. At least one counter-current jet of a drying gas is provided above the bed. The jet of drying gas is directed downwardly so as to impinge on the upper surface of the bed through which the current of gas rises. The bed of pellets is thus dried with the current of drying gas flowing through the bed from below as well as the jet of drying gas impinging on the upper surface of the bed. The term "jet" herein refers to a relatively high speed stream or sheet of gas that is restricted to a specific area. A preferred form of the invention includes a second stage in which a downwardly directed jet of drying gas is used together with a downward current of drying gas. The present invention also contemplates the possibility of reversing upward and downward flow directions so, for example, in the first stage the current of drying gas could flow downwardly with the counter-current jet being directed upwardly onto the lower surface of the bed. Thus the terms "up" or "down" or "upwardly" or "downwardly" herein indicate directions relative to one another rather than to the earth.

THE FIGURES

DETAILED DESCRIPTION OF THE INVENTION

Figure 1:
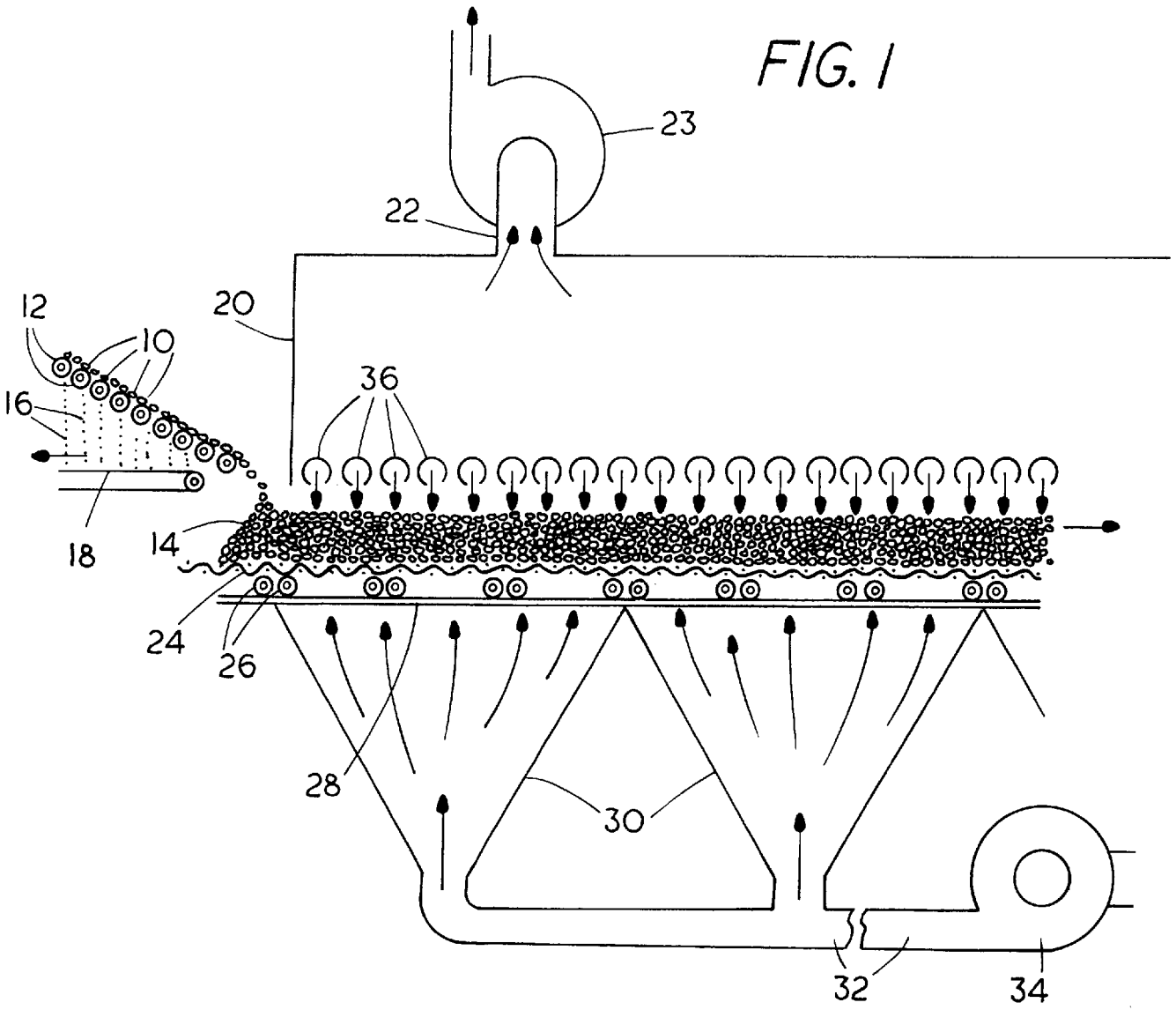
FIG. 1 is a diagrammatic vertical longitudinal sectional view of an apparatus embodying the present invention.

The present invention functions to improve drying at the top of the pellet bed by blowing at least one counter-current jet of hot air downwardly into the pellet bed. The downwardly directed jet impinging against the top of the pellet bed in the updraft drying zone (UDZ) of the furnace has a higher flow velocity than the upward current of air. The jet will thus overcome for an instant the upward movement of air in the air current, but because the upward movement of air is continuous, the downward jetting of air will not interfere with, i.e., stop, the upward movement of air. Each jet of air emerges from a slot typically about 3 inches above the pellet bed. The impingement of the air jet against the pellets has a very noticeable effect compared to the current of air that is drawn or forced upwardly through a bed of pellets as will be understood by those skilled in the art. For one thing, it removes the boundary layer of gas at the surfaces of the pellets in the upper layers of the bed.

The following description focuses on the removal of water from the top portion of a pellet bed. The invention is described by way of example, beginning with the first phase of a standard travelling grate furnace in solving some problems that occur in the updraft drying zone (UDZ) of a pelletizing furnace. It will be assumed that the conveyorized furnace has 8-foot wide conveyor pallets and five windboxes 8 feet by 8 feet in the UDZ, for a total drying zone 40 feet long. The pellets are assumed to have a mean diameter of ⅜ inch and a water content of 10%.

The jet action is provided by a series of slotted supply pipes or other type ducting installed across the top of the pellet bed. Above the first windbox, the supply pipes are spaced as close to each other as practical, e.g., three pipes per foot. Each pipe or duct has a ⅜" to ½" wide slot or jet opening extending its entire length. Each slot is on the bottom to enable hot air to be directed downwardly onto the pellet bed. Each pipe is typically about 3 inches above the top of the pellet bed. The distance of the pipe or duct above the pellet bed should not interfere with the conveyor operation.

While the air jets can be directed vertically, in some cases the air is blown downwardly at a slight angle, either into or with the direction of travel of the conveyor in the traveling grate machine. The hot air should travel about 2.5 inches into the bed of pellets with significant force. At about 4 inches into the bed, the jet will have a reduced force or velocity.

At the 4 inch depth it is necessary to warm the surface of a given pellet only a few degrees warmer than it would be without the jet. Warming the surface of a pellet only a few degrees warmer than the upward current of air is, however, highly effective since this is all that is needed to prevent condensation. It should be understood that the upflow of air is controlled by the temperature of the pellets in the area that the air is passing through. However, conductive heat transfer also has a small warming effect on the pellets at the 4-inch depth.

The jet above windbox WB1 blows hot air down into the first 2 or 3 inches of the pellet bed. The pellets contacted by the hot air jet are then warmed well above the dewpoint temperature. The top pellets then begin to be dried, significantly drier as they become heated on the outside. Water evaporates from the outside and some evaporation begins on the inside of the pellet.

The warming and drying of the top pellets will continue through the entire updraft drying zone because the counter-current jet will continue to penetrate into the pellet bed. The spacing between the jet supply pipes can be reduced so that they are spaced on about one foot centers or so for the rest of the 40 foot DDZ.

The pellets are warmed by the hot air jets, but cooling of the pellets also occurs when the relatively cool saturated air current flows by the pellets in an upward direction. The consequent cooling of the pellets does not cool them below the dewpoint temperature, but physical water transfer may cause some of the pellets near the bottom (say, the bottom 4-inch layer) to get wet sporadically.

It is assumed that the furnace has adequate hood exhaust fan capacity to handle a significant upward current of air. Each furnace must be evaluated to determine the volume of jetted air needed to dry the top of the pellet bed. Furnaces with lower excess air capacity will use smaller jets and their spacing will be increased. As described more fully below, proper design will permit one to use as much hot jetted air as required. A greater benefit will result from using more air. In a system with higher air volume, the top 2.5 inches of pellets may be dried to 5% water. In the less aggressive system, the pellets may be dried to about 7% water. In either case the pellets leaving the updraft drying zone of the furnace will be significantly drier than what presently exist without the downward jetting of hot air.

In equipment employing the present invention, the resistance to airflow will be reduced for updraft drying. The lower resistance will provide the possibility of increasing the general air current so as to achieve better drying for the pellets below the top 4 inches of the pellet bed. This extra drying will improve the furnace operation.

Better drying of the pellets in the top 4 inches of the pellet bed that is achieved with the present invention will make the final product better because the drier pellets will not have the course rough surface that is caused by being wet due to condensation on the pellets surface. The course rough surface is one of the leading causes of dust in the finished pellets.

The next zone of the furnace is the downdraft drying zone (DDZ). To improve drying in this zone of the furnace, a current of hot air is blown down into the top of the pellet bed. The slots for the jets are very close to the top of the pellet bed, e.g, 1.5 to 2 inches away. Energy to create the downward velocity of each jet is provided by the static pressure developed by a fan. The volume of air jetted down onto the top of the pellet bed is designed to balance the amount of air exhausted by the waste gas fan connected to the windboxes in the DDZ. The waste gas fan provides negative suction to assist in drawing the jetted air through the pellet bed. All the air is travelling from the top of the pellet bed and down to the bottom of the pellet bed. For this reason the volume of air that is jetted down onto the bed will be adjusted to slightly exceed the volume of air in the current entering the hood over the DDZ.

Most of the surface water was removed in the updraft drying zone of the furnace by using counter-current downward jetting of hot air. However, in the downdraft drying section of the furnace most of the benefit will be in heating the pellets in the top 4 inches of the pellet bed. The removal of water is achieved by raising the temperature of the top 4 inches significantly above the boiling temperature of water. Additionally, water of hydration is also removed at temperature above 212° F. Additional drying is accomplished on the pellets below the 4-inch depth because the air is hot when it first penetrates to that depth.

A plurality of narrow slots preferably provide the downwardly directed air jets. Some or all of the slots can direct air jets at a slight angle into the movement of the travelling grate machine, and some can be used to direct the air with the movement of the travelling grate machine. However most of the slots will direct the air jets vertically into the pellet bed. The slots are typically about one-quarter to three-eighths inch wide. The jet velocity is about 2000 feet per minute to 3000 feet per minute at a temperature of about 800° F. The slot width and air velocity can, however, be changed depending upon the design specifications encountered.

Prior to final installation of the jet supply pipes, the volume of air exhausted by the hood exhaust fan and the waste gas fan is measured. Airflow of specific ductwork should also be measured to engineer the proper air balance.

The benefit of drying the top of the pellet bed can be appreciated when it is recognized that the prior system in use introduced pellets into the firing zone of the furnace with a water content of nearly 10% for the top 4 inches of the pellet bed. When the invention is used in the first two drying zones, the top 4 inches of the pellet bed entering the downdraft firing zone will have a water content as low as 4% which results in a significant improvement in the quality of the pellets produced. Increased furnace capacity in tons per hour is another important benefit.

A firebrick wall a few feet thick usually separates the downdraft drying zone (DDZ) from the downdraft firing zone (DFZ). Hot air jets according to the present invention are also provided in the area below the brickwork. This additional jetting is directed into the travelling movement of the pallets, i.e., by directing the jets slightly upstream. This will dry the pellets slightly more before they enter the firing zone.

Refer now to the drawings which illustrate by way of example a preferred mode of practicing the present invention, for example in drying magnetite pellets.

As shown in FIG. 1, green, freshly-formed pellets 10 are carried downwardly from left to right on a roller feeder screen indicated diagrammatically at 12 to a drying bed 14 which is typically about 15–18 inches thick. Fines 16 fall from the feeder screen 12 onto a conveyor 18 and are carried back to the pelletizer for reprocessing. Positioned over the bed 14 is a drying hood 20 having an outlet duct 22 that is connected to an exhaust fan 23 for drawing gas upwardly as indicated by arrows. The bed 14 of pellets 10 is typically supported on an endless conveyor screen, e.g., a pallet-style conveyor 24 that is connected to supporting rollers 26 which ride on longitudinally extending rails 28 so as to carry the bed 14 from left to right in the figures at a slow rate, e.g., eight feet per minute. Below the bed 14 and communicating with the bed 14 through the supporting conveyor 24 are a plurality of transversely extending, longitudinally distributed windboxes 30 beginning with number 1 in FIG. 3 proceeding from left to right, to which drying air is supplied to a duct 32 which communicates with a blower 34 for forcing the air into the windboxes 30 so as to blow a current of heated drying air upwardly through windboxes 1–5, thence through the portion of the bed 14 above each successive windbox 30 to at least partially dry the pellets 10 in the bed 14. Moisture-containing drying air is removed from the hood 20 through the exhaust outlet 22. Such a furnace is referred to as a "traveling grate furnace." In such a furnace, iron ore pellets are distributed across the width of grate pallets which make up the conveyor 24. The trip through the dryer usually lasts about five minutes. Previous to the present invention, the top of the pellet bed 14 had about six inches of wet pellets.

Figure 2:
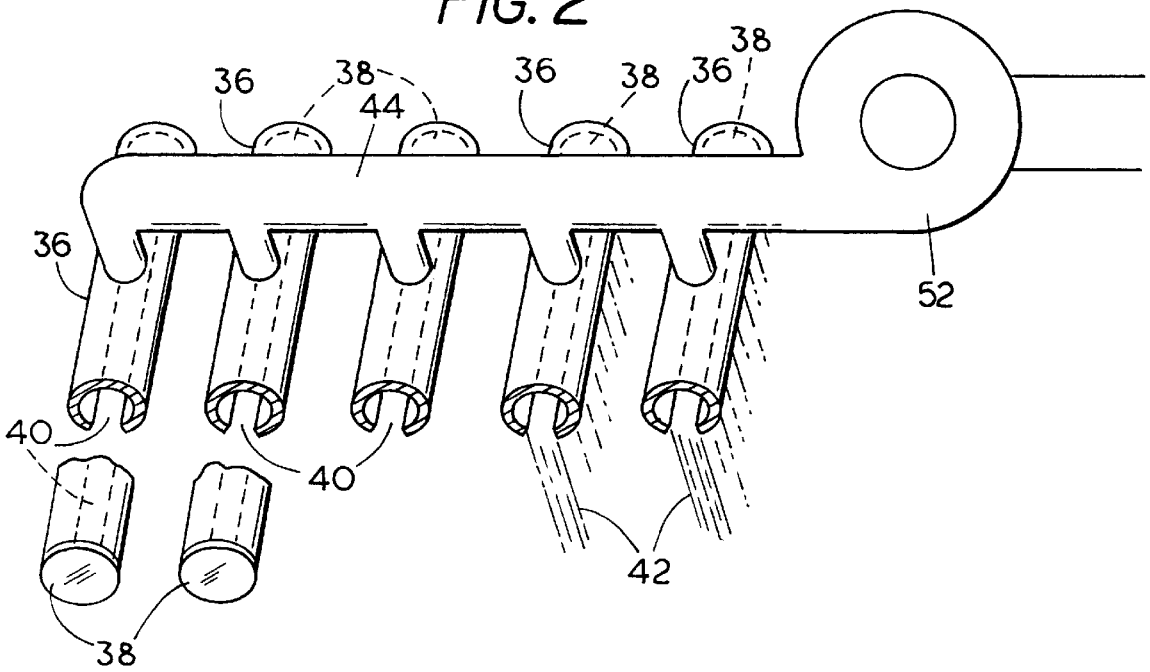
FIG. 2 is a diagrammatic perspective view showing pipes for providing counter-current drying gas jets in accordance with the present invention.

Refer now to FIG. 2. Positioned above the bed 14 and spaced apart from the bed a short distance, typically from about two to four inches, are a plurality of laterally extending, horizontally disposed drying gas supply pipes or ducts 36, each of which is closed on each end by means of end walls 38. Each pipe 36 is provided with a downwardly opening slot 40, typically from about one-quarter inch to about one and one-half inches in width. The slot is typically about one-half inch wide for a supply pipe 36 that is about five to eight inches in diameter. Each slot produces a downwardly directed sheet-like jet of drying gas 42 (FIG. 2) that impinges on the upper surface of the bed 14 of pellets 10. Drying air heated to about 800° F. is supplied to the pipes 36 via a supply pipe 44 from a blower 52.

Figure 4:
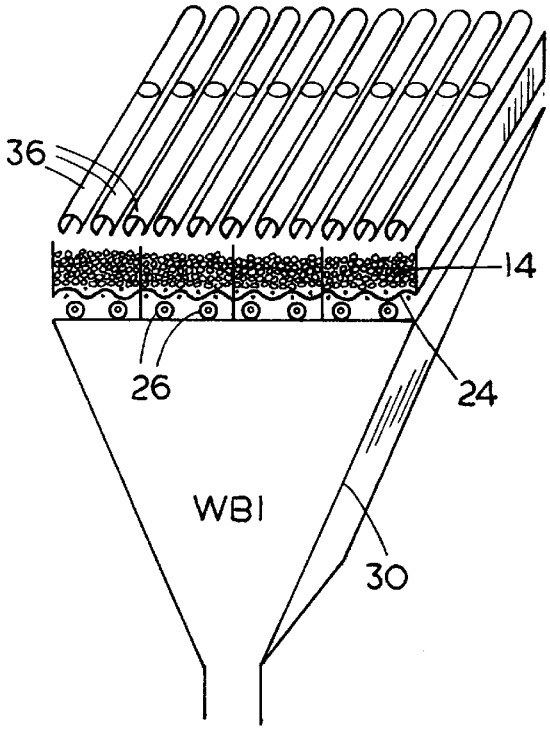
FIG. 4 is a diagrammatic perspective view of a portion of FIG. 3 on a larger scale.
Figure 3:
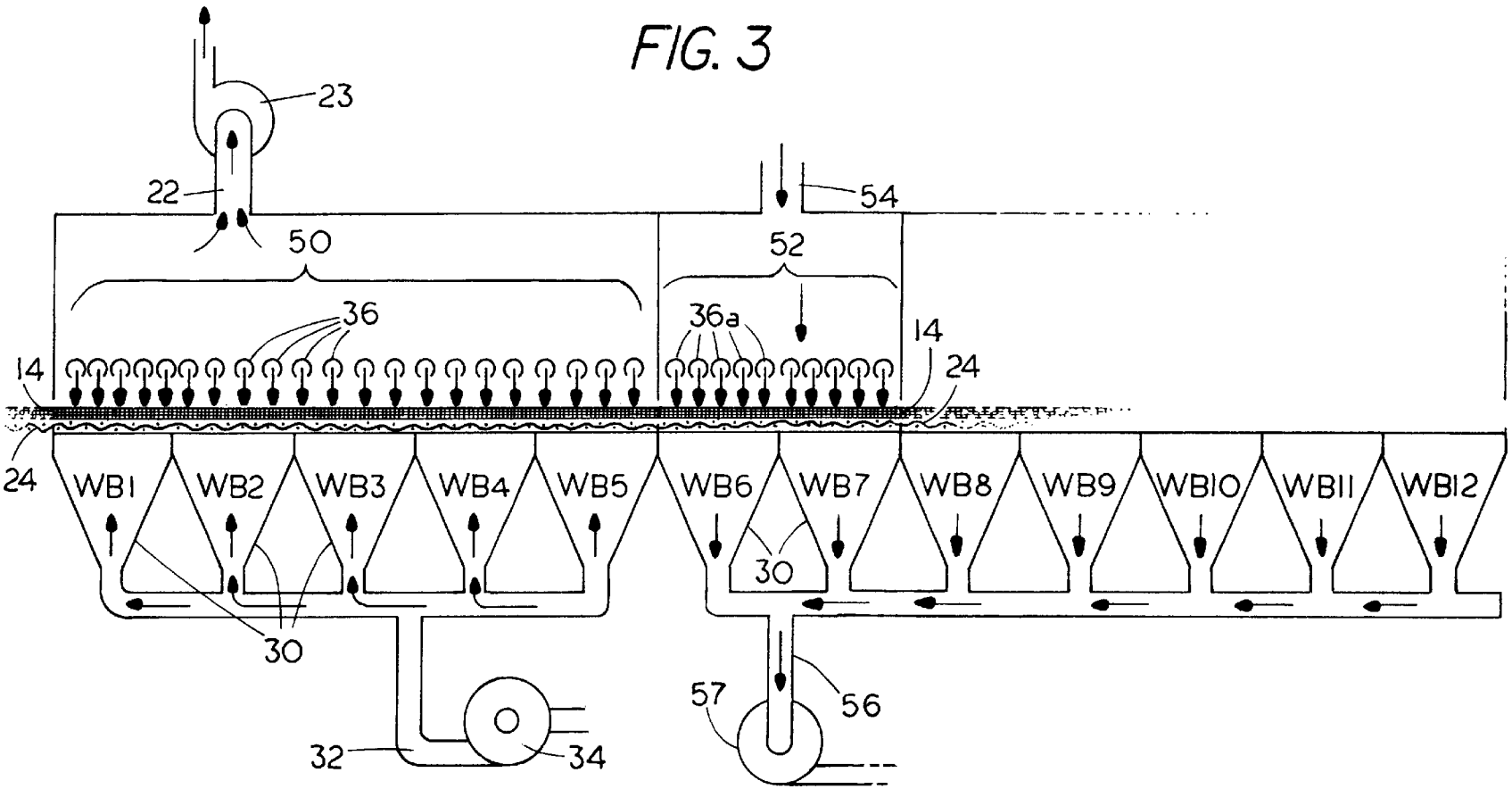
FIG. 3 is a diagrammatic longitudinal vertical cross-sectional view showing successive drying stages in accordance with the present invention.

As shown in FIGS. 3 and 4, typically a plurality of windboxes, e.g five, (WB1–WB5) are provided in a hooded exhaust updraft drying section 50. While the width of the drying bed can vary, it is typically about eight feet wide and consequently the drying pipes 36 are each about eight feet long. The drying air passing through pipe 44 (FIG. 2) is supplied at a rate sufficient to produce a slot velocity of about, say, 3000 feet per minute in the jet 42 as it leaves the slot 40. Typically each eight-foot drying air supply pipe 36 will discharge about 1000 cubic feet per minute of hot drying air. The slot width, the discharge velocity and the cross-sectional shape of the pipes 36 can be changed as desired. The pipes 36 can be round, rectangular, oval or of other shapes best suited to the requirements of the fabricator.

After the bed 14 has passed the last windbox WB5 of the exhaust hood section 50, it enters a downdraft unfired drying zone, i.e., the DDZ 52 (FIG. 3) which is supplied with heated air via duct 54 at a temperature of, say, 800° F. traveling downwardly through the bed 14 thence through windboxes WB6 and WB7 and out through exhaust duct 56 to further dry the pellets 10 in the bed 14.

In FIG. 4 is shown a typical windbox which may be about eight feet wide and about eight feet long as seen in plan view. As shown in FIG. 4, four individual pallets comprising portions of a conveyor cover one windbox. The rate of travel of the conveyor is usually about eight feet per minute, thus any individual pellet is above a windbox for about one minute.

Figure 5:
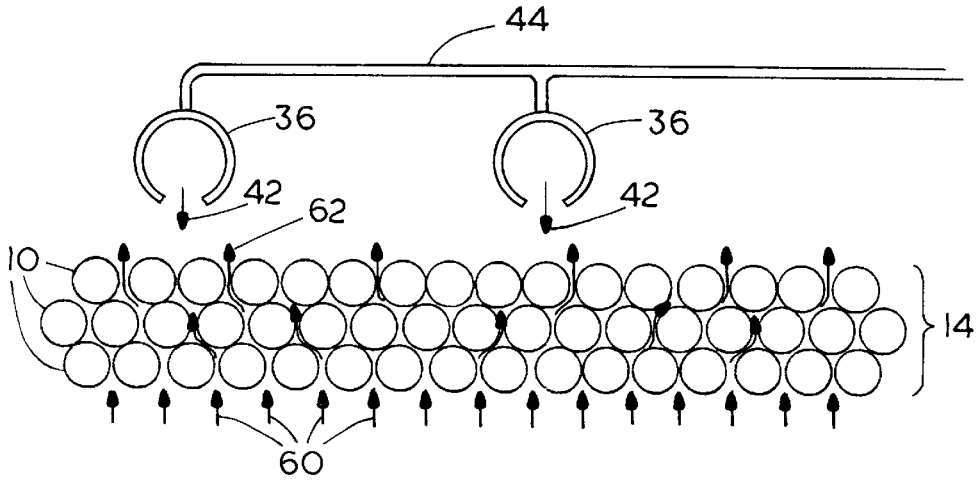
FIG. 5 is a diagrammatic longitudinal sectional view on a larger scale showing the flow of gas during the first stage of drying.

Refer now to FIG. 5 which illustrates diagrammatically the drying in the bed 14 during the initial drying stages above one of the windboxes WB1-WB5 which carry air upwardly through the bed 14. As shown in FIG. 5, a current of heated air 60 flows upwardly through the bed 14 around and between the pellets 10 and is exhausted from between the pellets 10 in the bed 14 as shown at 62. Simultaneously, the jets 42 of hot counter-current drying gas are forced downwardly from the supply pipes 36 and impinge on the upper surface of the bed 14. The downwardly directed jets 42 are effective in further drying the upper layer of pellets 10, particularly the first two to three inches from the top surface of the bed 14 since the upwardly traveling current of air 40 is heavily laden with moisture. While no dramatic increase of pellet temperature is achieved by any particular downwardly directed jet 42, each one-half inch wide jet or sheet of air at 800° F. will have pellets exposed to it and under its influence for about one second. After about one second of heating by the jets, the pellets thus heated will be exposed to cooler air 62 from the upward current of drying air 40 for about 15 seconds, thereby removing some of the heat from each of the pellets heated by the jet 42. Thus, while no particular jet 42 by itself produces a dramatic increase in pellet temperature, it is important to recognize that the jets 42 keep the top layer, say, the top two or three inches of pellets, above the dewpoint temperature of the surrounding drying gas. Thus, the hot air jets in the updraft section 50 minimize condensation that would otherwise occur on the pellets 10 without the jets.

Figure 6:
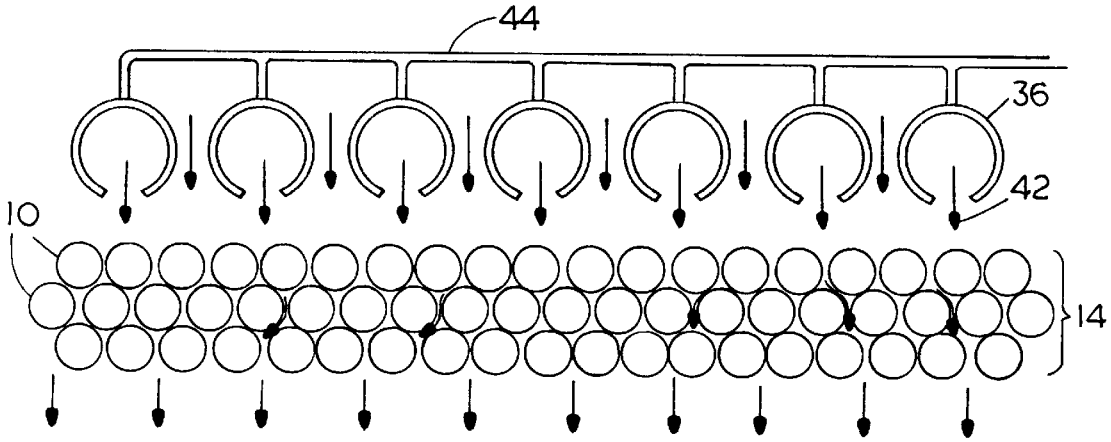
FIG. 6 is a view similar to FIG. 5 showing the flow of drying gas in a subsequent stage of drying.

Refer now to FIG. 6 which illustrates the benefits that are achieved when the pellets 10 enter the unfired downdraft drying zone 52 of FIG. 3. In this section, suction provided by a waste gas fan 57 (FIG. 3) draws waste gas at a temperature of, say, 800° F. downwardly through the bed 14 from the inlet 54. Inlet 54 supplies hot air under pressure to drying zone 52. The hot air supply pipes 36*a* in the downdraft drying section 52 provide momentum to each air jet, forcing air more effectively through the top two or three inches of the pellet bed 14. Significant added drying therefore occurs. The pellets 10 are in the downdraft drying section 52 typically for about two minutes. The very uppermost layer of pellets, say the top one inch of pellets 10 in the bed 14, are usually dried to about 3% by weight water which is located mainly in the center portion of each pellet 10.

Figure 7:
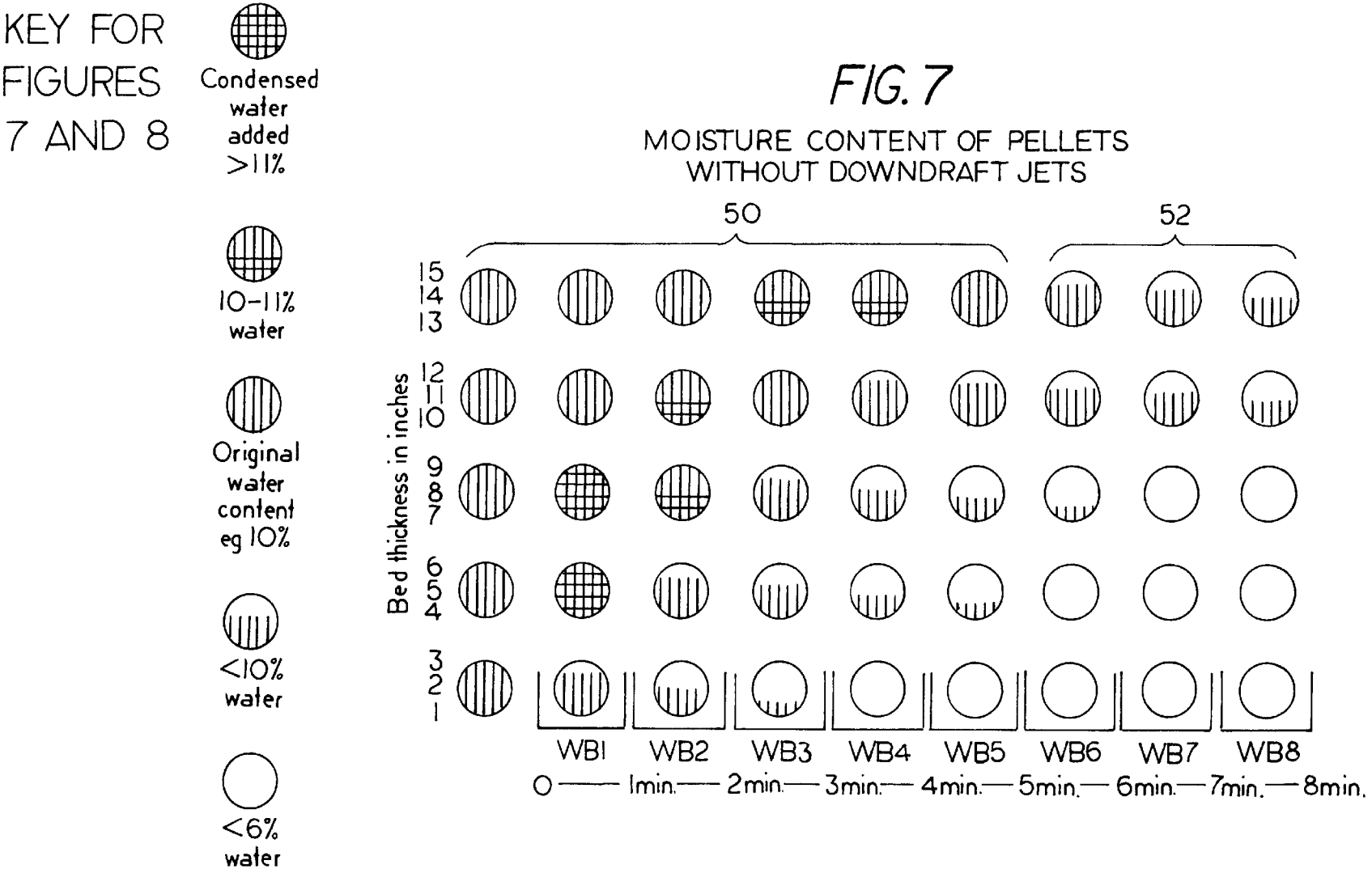
FIG. 7 is a diagram depicting the moisture content of the pellets without the downdraft jets of the present invention.
Figure 8:
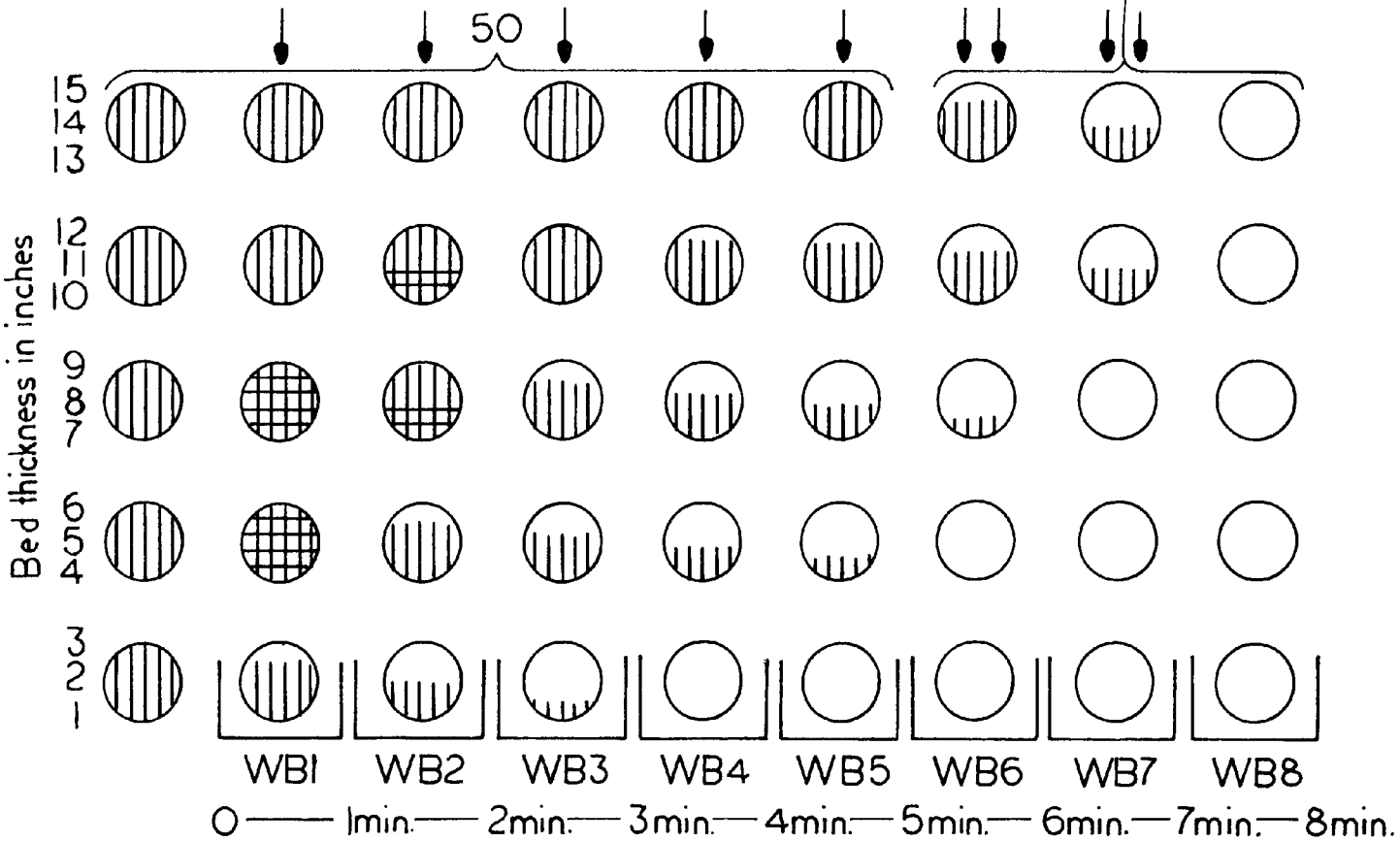
FIG. 8 is a diagram similar to FIG. 7 but depicting the moisture content of the pellets with the downdraft jets of the present invention.

Refer now to FIGS. 7 and 8 which illustrate moisture content of the pellets 10 above various windboxes without the downdraft jetting (FIG. 7) and with downdraft jetting (FIG. 8). In windbox WB1, after about one minute with an 800° F. upward current of air, the bottom pellet is dried on the surface while the inside is still wet. The estimated water content is about 8% for about 1–3 inches from the bottom of the bed 14, while the water content at the 4–9 inch level is even greater at about 11% to 12% on average. In FIG. 8 showing the invention, the moisture content of the pellets 10 in WB1 will be about the same as in FIG. 7.

In windbox WB2, without the invention (FIG. 7) the estimated water content will be about 5%, but in the invention (FIG. 8) some water has been removed in the 1—3 inch level. In FIG. 8 at the 4–6 inch level, the water content will be about 8%; at the 7–13 inch level it will be about 12%, and the top inch of pellets may have about a 9% water content. Pellets in the top three inches will be warmed above the dewpoint of the drying air.

In windbox WB3, without the invention (FIG. 7) the estimated water content will vary from about 2% in the 1–3 inch levels and about 12% in the 13–15 inch levels. WB3 in FIG. 8 using the invention will be about the same, with the top layer of pellets back to their original 10% moisture content. The added water does not come from condensation but from physical movement of the water.

In windbox WB4, after four minutes of treatment, the bottom zone is nearly dry in FIG. 7 and at successively higher levels varies from 3% to 11%. In windbox WB4 of the invention (FIG. 8) moisture contents are the same except for the top zone which is only 9%, thus showing the benefit of the present invention.

After five minutes without the invention, the 1–3 inch levels are dry in windbox WB5 and moisture increases up to the 13–15 inch level which is about 10%. By contrast, with the invention in windbox WB5 the top 15-inch level is only about 7% to 8% water and therefore appears dry.

Without the invention (FIG. 7), after one minute of downdraft in windbox WB6, the bottom levels remain the same. At the 13–15 inch level, moisture content is about 8% and in the 10–12 inch level the moisture content is 7%. In the invention by contrast (FIG. 8), the moisture content at the 13–15 inch level is only 6% and that drops to 4% in windbox WB7 and to a very low level, about 3% or below in windbox WB8. By contrast, in windbox WB7 after two minutes without the invention (FIG. 7), the 13–15 inch level is 7% and at 10–12 inches is about 6% moisture.

Assume that the bed 14 travels into the downdraft firing zone WB8–WB12 without the invention. In windbox WB8 after one minute exposure to a downdraft at about 1600° F., the 13–15 inch level would still be at about 6% moisture, too wet for good firing.

Figure 9:
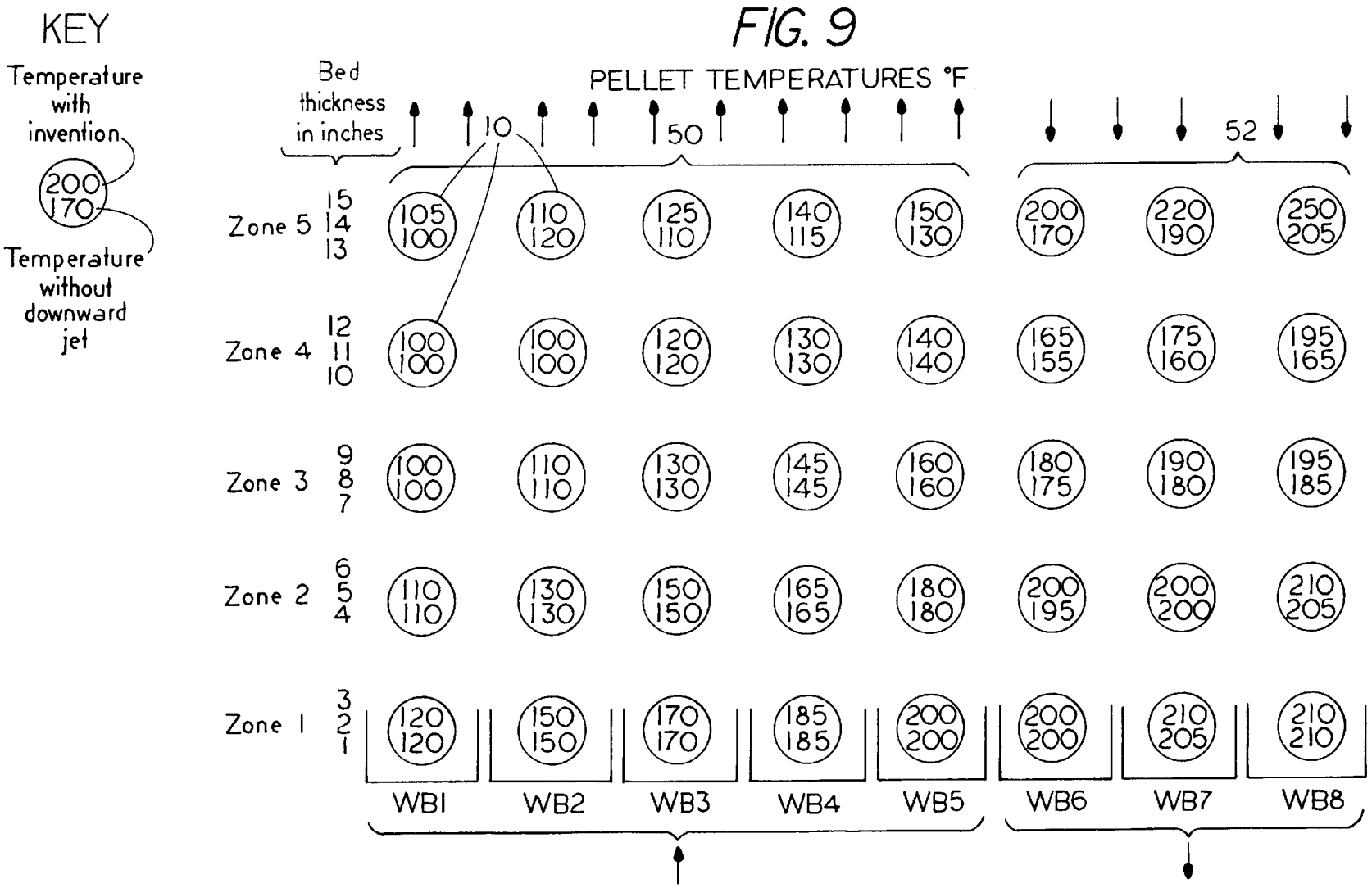
FIG. 9 is a diagrammatic depiction of the temperature of the pellets with and without the invention at different levels in the bed.

Refer now to FIG. 9 which illustrates the temperature of the pellets 10 at various bed thickness levels in the different windbox areas. It will be noted that the temperature achieved with the invention (shown at the top of each pellet) is generally higher than that of the prior art (shown at the bottom of each pellet), particularly in the upper levels, e.g. zones 4 and 5 of the bed 14. It will also be noted that the invention achieves a pellet temperature of 250° F. in zone 5 of WB5. By contrast, a temperature of only 205° F. is achieved in zone 5 without the jets 42. In zone 4, the invention achieves a temperature of 195° F. compared with 165° F. without the downwardly directed jets 42. The pellet temperatures of the invention in zones 3 and 2 in the last windbox WB8 is also higher than without the invention. Thus, the average temperature of the pellets 10 in most zones of the pellet bed 14 is higher using the invention. While the temperature increases due to the hot air jets 42 in accordance with the invention are not dramatic, the invention provides a critical advantage by keeping the top few inches of the pellet bed 14 above the dewpoint while in the updraft drying zone 50. An important temperature improvement is also achieved by the present invention in the downdraft drying zone 52 of the furnace.

Figure 10:
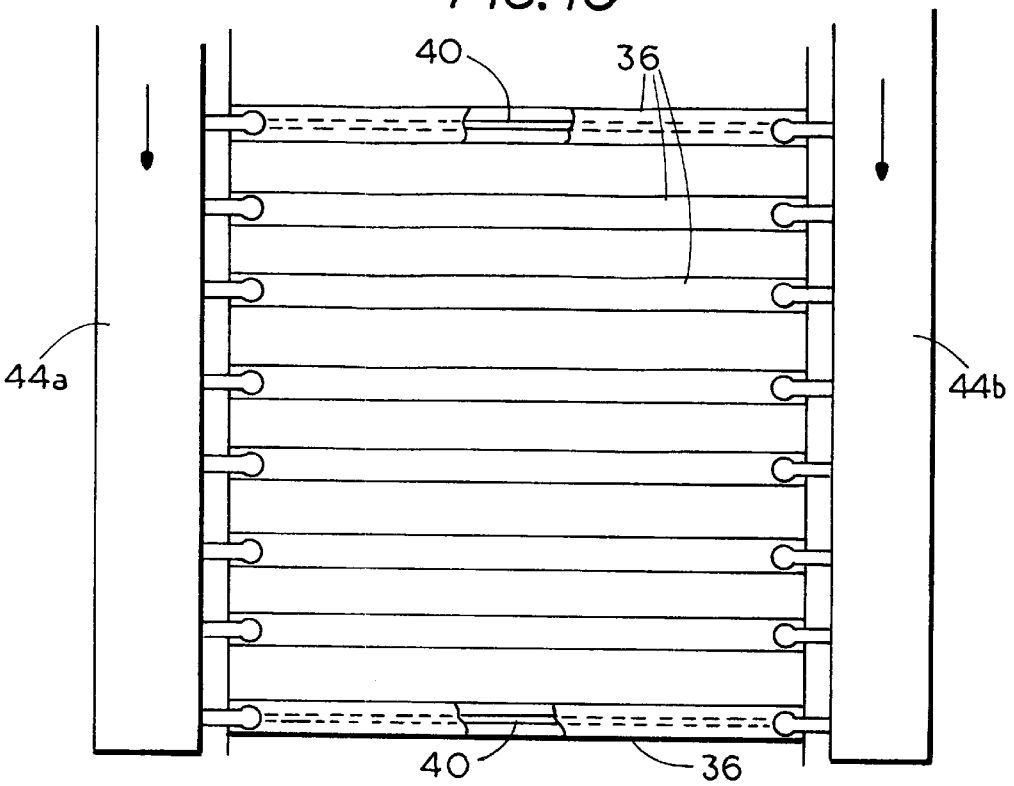
FIG. 10 is a diagrammatic plan view partly in section showing how air is piped to the air jets in accordance with one form of the invention.
Figure 11:
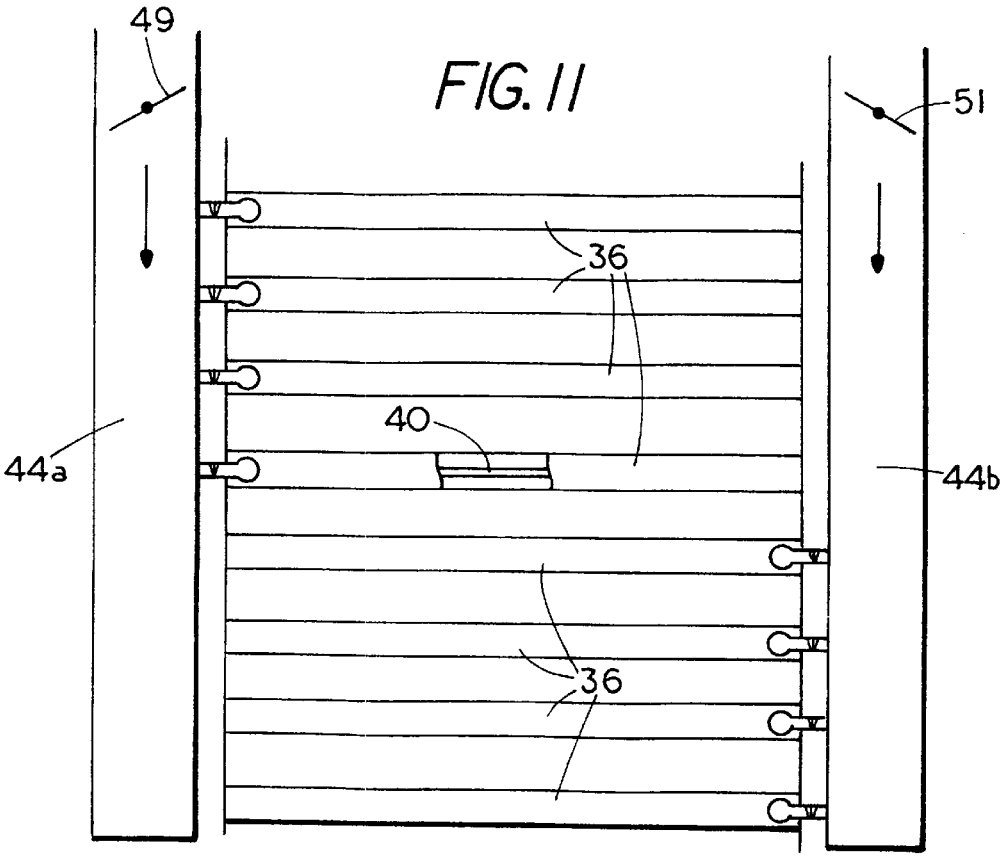
FIG. 11 is a view similar to FIG. 10 showing how air can be piped to the jets in accordance with another embodiment of the invention.

Refer now to FIGS. 10 and 11 wherein the same numerals refer to corresponding parts already described. In FIG. 10, the heated drying air supplied to the pipes 36 is provided by means of a pair of supply ducts 44*a* and 44*b* connected to opposite ends of the pipes 36 to assure equal distribution of hot air that is forced downwardly through the slots 40 to provide the downwardly directed sheet-like currents of air 42 (FIG. 2). The ducts 44*a* and 44*b* can be used to assure that an equal air supply is provided to each end of the distribution pipes 36. In the alternative, a single supply duct 44*a* can be provided with equal distribution achieved through dampers or blast gates (not shown) within the distribution pipes 36.

In FIG. 11, hot air is supplied to four distribution pipes 36 at the top of the figure by the supply duct 44*a* at the left and to the remaining distribution pipes 36 are supplied by the supply duct 44*b* at the right. Thus, in this case, the hot air which may be supplied from a suitable furnace location via a blower (not shown) is introduced to opposite ends of different ones of the distribution pipes 36 so that any differences at opposite ends of a given pipe, as well as different temperatures in the duct 44*a* versus duct 44*b* will cancel out after all of the pellets have passed the distribution pipes 36. Any one side of the furnace should not be supplied by significantly more air (say, more than 25%) than the other side. Balancing in FIG. 11 can also be assisted by the use of dampers such as dampers 49 and 51.

Pellet Drying Mechanism

In the updraft drying zone, water is first removed from the surface of the pellet and from a thin layer of the concentrate on the outside of the pellet. This drying occurs before the hot air is saturated with water vapor. The evaporation of water, however, lowers the temperature of the air consistent with the heat of vaporization of water. The air temperature is also lowered slightly due to sensible heat transfer.

When the saturated air comes in contact with cold pellets above those that were being dried, water condenses on the colder pellets. The condensing action warms the pellets significantly, but because in the beginning there is an abundance of cold pellets, most of the water is condensed before the air reaches the top of the pellet bed. This is particularly true if one considers the progression through the drying zone as occurring in one-minute increments as described in the earlier drawings.

The evaporation and condensing occur for the entire five-minute drying zone. Some of the less obvious characteristics of pellets should be understood to appreciate the advantages achieved during the drying of pellets. Some of the mechanisms of pellet drying will therefore be explained in more detail.

The surfaces of pellets are initially moist so that when hot air is forced up and around a pellet, the surface water and some of the water in a thin layer of pellet material is evaporated. When this occurs, some heat is transferred by water into the center of the pellet because water conducts heat fairly well. The water in the center of the pellet is warmed to a temperature below the boiling point of water, but probably near 150° F. in some instances. After the surface water leaves the pellet, there is significantly lower transfer of heat into the center of the pellet because the finely ground particles do not transfer heat efficiently due to little surface-to-surface particle contact. This may first appear to be a problem, but careful consideration will show that it provides advantages in drying taconite pellets. Updraft drying is actually improved because most of the bottom pellets have the surface water removed from the bottom of the pellet bed, then very little heat transfer takes place at that level and the hot air contacts the next upper layer of pellets. The same mechanism takes place on subsequent upper layers of pellets. The pellets near the top of the bed are not adequately dried due to furnace tonnage requirements, but the top pellets are warmed to about 180° F. for most operations.

The hot air jets 42 warm the surface of the top two inches of the pellet bed above the dewpoint temperature. The combination of the warm updraft drying air plus the hot air jets 42 result in a dry surface on the pellet including a thin layer of dried concentrate on the surface of the pellet. The pellets that leave the updraft drying zone that were also heated by the hot air jets 42 enter the downdraft drying zone of the furnace hot and dry enough to benefit from the hot air jets in that section of the furnace.

The top few inches of pellets entering the downdraft drying zone are heated continually for the next two minutes with the hot air jets forcing air down into the bed of pellets. The normal furnace drafting will continue to draw the hot air through the pellet bed. The top few inches of pellets are dried much better because of the hot air jets. The slow transfer of heat described earlier still exists, but water is removed from the center pellet faster with the addition of the hot air jets. The pellets leaving the downdraft drying zone are thus heated well above the boiling temperature of water. While some water may still be bound hydroscopically to the binders or other additives, most the water will be removed.

In the downdraft firing zone of the furnace, the air temperature is high enough, e.g., 1800° F., to start oxidizing the top pellets. The oxidation will be slow because of the slow transfer of heat described earlier (due to small irregularly shaped particles) and also because of the low oxygen content of the air. Slow oxidation may prove to be a benefit because there is a minute or two available to permit the heat from oxidation to remove all the water from the center of the pellet, which is an important advantage since water in the center of pellets retards oxidation and results in the magnetite core in the center of pellets. This dissimilar material is the main reason that pellets have a lower than desired compression test.

With no hot air jets, some pellets leave the updraft drying zone 50 saturated with water. When the pellets reach the downdraft drying zone, the hot air does not penetrate the layers of wet pellets. The hot downdraft drying air evaporates the surface moisture is cooled by the heat of vaporization. Further drying is slowed and, as a result, when the pellets leave the downdraft drying zone they have a center that has about 5% water. The hot gases in the downdraft firing zone begin the oxidation of the magnetite pellet. The oxidation is severely retarded by the water in the center of the pellet. The water that is evaporated prevents heat transfer and oxygen transfer. The result will be pellets with magnetite cores and a low compression test rating. The present invention drastically reduces or eliminates all of these problems.

The invention will thus heat and dry the pellets more effectively and more uniformly than the prior art. It can be seen that an important advantage of the invention derives from heating the pellets on the top two or three inches of the pellet bed 14, since those are the pellets that have the poorest quality. The fact that the top pellets stay wet is one of the factors that produces pellets of lower quality. Another factor is that pellets were heretofore fired in a low oxygen atmosphere because oxygen is consumed in raising the air temperature to about 1800° F. and later to about 2400° F. in the firing zone (windboxes WB8 and above). Preliminary calculations indicate that the distribution pipes 36, while they can be of various sizes, should have a diameter of about eight inches for a one-half inch slot 40. However, with a smaller distribution pipe of, say, four to five inches in diameter, dampers and baffles can be installed as will be apparent to those skilled in the art to achieve an approximate equal volume of air blowing out through all of the slots 40. It should be understood that the distribution of air does not have to balanced perfectly and, as shown in FIGS. 10 and 11, balancing can be accomplished by feeding air to opposite ends of the distribution pipes 36 rather than to the center (FIG. 4).

An important advantage of the present invention is its adaptability for use in existing pellet drying equipment, that is, as an after-market unit to be installed in equipment now in use. Other benefits of the present invention will be better understood when one considers that for each 200 tons of product produced with 10% water, there is an input of 220 tons of material. Because of the spherical shape of the pellets and the water present, the density of the pellets is about two or slightly less. Therefore, a cubic foot of pellets weighs about 100 pounds. Two hundred twenty tons per hour is 3.7 tons per minute, or 7,330 pounds per minute, i.e., 73 cubic feet per minute. On a machine eight feet wide with a bed 15 inches deep, the machine would have to move 7.3 feet, or about 90 inches a minute to maintain a steady operating production rate. This volume of material shows that even a small reduction in moisture has far-reaching benefits.

It has been observed that moisture condenses inside the exhaust hood in some prior art installations. Moisture can and does also condense on cold pellets. The present invention reduces both of these conditions and in that way improves the final product.

Thus, the present invention enhances drying by using the downward jets 42 of hot air impinging on the top layer of the pellets to heat the top layer of pellets above their dewpoint temperature so the pellets are dryer on the top of the pellet bed 14 from the drying in the updraft zone 50. The downward jets in the downdraft drying zone will dry the pellets in the downdraft zone 52 at least three or four inches deep into the pellet bed 14. The pellets 10 typically pass through this zone of the furnace in two minutes and are much drier leaving the downdraft zone 52 than they would be without the present invention. In the next zone of the furnace, the downdraft drying fired zone (windbox WB8 and higher) the pellets are heated to about 1800° F. Because of the improved drying made possible by the present invention in zones 50 and 52, improved firing can be achieved without damaging the pellets.

Many variations of the present invention within the scope of the appended claims will be apparent to those skilled in the art once the principles described herein are understood.

What is claimed is:

1. A method of drying iron ore pellets comprising the steps of, forming moisture-containing pellets into a bed comprising a multiplicity of the pellets, said bed having an upper and a lower surface, forcing a current of drying gas upwardly through the lower surface of the bed of pellets, providing at least one counter-current jet of a drying gas above the bed, said jet being directed downwardly so as to impinge on the upper surface of the bed, and drying the pellet bed with both the current of drying gas from below the pellets as well as the jet of drying gas impinging on the upper surface of the bed.

2. The method of claim 1 wherein a plurality of said jets are provided and each of the jets is elongated so that each comprises a sheet-like jet of drying gas directed downwardly and impinging on the upper surface of the bed.

3. The method of claim 2 including, supporting the bed on a conveyor and conveying the pellets in the bed beneath the jets one after another by means of the conveyor.

4. The method of claim 1 wherein the bed of pellets is thereafter exposed to a downward current of drying air and at least one jet of drying gas is provided above the bed within the downward current of drying air so as to impinge on the upper surface of the bed while the bed is exposed to the downward current of drying gas.

5. The method of claim 4 herein a plurality of said jets are provided within the downward current of drying air, each of the jets is elongated so that each jet comprises a sheet-like jet of drying gas directed downwardly and impinging upon the upper surface of the bed while the bed is exposed to said downward current of drying air.

6. The method of claim 1 wherein the ore is magnetite.

7. The method of claim 1 wherein the ore is hematite.

8. The method of claim 1 wherein the ore is limonite.

9. The method of claim 1 including, providing a second zone having a drying gas current flowing in a direction in the reverse of said current of drying gas, providing at least one jet of drying gas above the bed in the second zone such that the jet of drying gas in the second zone flows in the same direction as said drying gas current in said second zone.

10. The method of claim 9 wherein a plurality of said jets are provided in each of said zones and each of the jets is elongated so that each comprises a sheet-like jet of drying gas directed downwardly to impinge on the upper surface of the bed in both of the zones.

11. The method of claim 1 wherein the pellets initially contain magnetite and, the pellets are heated after the pellets have been thus dried to convert the magnetite through oxidation thereof to $Fe_2O_3$, such that the presence of magnetite cores in the center of the pellets is reduced or eliminated.

12. An apparatus for drying iron ore pellets comprising, means forming moisture-containing pellets into a bed comprising a multiplicity of the pellets, said bed having an upper and a lower surface, means forcing a current of drying gas upwardly through the lower surface of the bed of pellets, a gas supply having at least one opening to provide at least one jet of a drying gas above the bed, said jet being directed downwardly so as to impinge on the upper surface of the bed, such that the pellet bed is dried with both the current of drying gas from below the pellets as well as the jet of drying gas impinging on the upper surface of the bed.

13. The apparatus of claim 12 wherein a plurality of said openings are provided to form a plurality of jets and each of the jets is elongated so that each jet comprises a sheet-like jet of drying gas directed downwardly and impinging on the upper surface of the bed.

14. The apparatus of claim 13 including a conveyor supporting the bed of pellets for conveying the pellets in the bed beneath each of said jets.

15. The apparatus of claim 12 including a downdraft drying zone for thereafter exposing the pellets to a downward current of drying air and including at least one jet opening for forcing a jet of drying gas within the downward current of drying air downwardly so as to impinge on the upper surface of the bed while the bed is exposed to the downward current of drying gas.

16. The apparatus of claim 15 wherein a plurality of said openings are provided within the downward current of drying air, each of the openings is an elongated slot to provide a plurality of sheet-like jets of drying gas directed downwardly and impinging upon the upper surface of the bed while the bed is exposed to said downward current of drying air.

17. The apparatus of claim 12 wherein the gas supply comprises a plurality of horizontally disposed, parallel, spaced apart, slotted distribution pipes and a supply duct is connected to each end of each distribution pipe.

18. The apparatus of claim 12 wherein the gas supply comprises a plurality of horizontally disposed, parallel, spaced apart, slotted distribution pipes and a first supply duct is connected to one end of some of the pipes and a second supply duct is connected to an opposite end of the remaining pipes.

* * * * *